US009227828B2

(12) United States Patent
Groesbeck

(10) Patent No.: US 9,227,828 B2
(45) Date of Patent: Jan. 5, 2016

(54) BAG-IN-BOX ADAPTER FOR WATER DISPENSER

(71) Applicant: R. Clay Groesbeck, Salt Lake City, UT (US)

(72) Inventor: R. Clay Groesbeck, Salt Lake City, UT (US)

( * ) Notice: Subject to any disclaimer, the term of this patent is extended or adjusted under 35 U.S.C. 154(b) by 321 days.

(21) Appl. No.: 13/844,806

(22) Filed: Mar. 16, 2013

(65) Prior Publication Data

US 2014/0261875 A1 Sep. 18, 2014

(51) Int. Cl.
*B67D 3/00* (2006.01)

(52) U.S. Cl.
CPC ..... *B67D 3/0067* (2013.01); *B67D 3/0035* (2013.01); *B67D 3/0038* (2013.01)

(58) Field of Classification Search
CPC .... B67D 3/008; B67D 3/0083; B67D 3/0035; B67D 3/0038; B67D 3/00932; B67D 3/0067
USPC ..... 141/18, 351, 363–366; 222/146.6, 160, 222/185.1
See application file for complete search history.

(56) References Cited

U.S. PATENT DOCUMENTS 3,060,703 A * 10/1962 Benua et al. ..... 62/394
3,688,950 A * 9/1972 Parish ..... 222/146.1
3,843,021 A * 10/1974 Schieser ..... 222/105
3,848,776 A * 11/1974 Schieser ..... 222/105
4,204,613 A 5/1980 Terzian et al.
4,421,146 A 12/1983 Bond et al.
4,445,551 A 5/1984 Bond et al.
5,456,387 A 10/1995 Trewhella
6,398,073 B1 * 6/2002 Nicolle ..... 222/67
6,442,960 B1 9/2002 Fournier et al.
6,557,735 B1 * 5/2003 Stray ..... 222/185.1
7,051,902 B2 5/2006 Rivard et al.
7,188,749 B2 * 3/2007 Miller et al. ..... 222/1
7,331,487 B2 * 2/2008 Macler et al. ..... 222/83
7,775,397 B2 8/2010 Rivard et al.
7,975,879 B2 * 7/2011 Groesbeck ..... 222/146.6
8,177,096 B2 5/2012 Macler
8,875,944 B2 * 11/2014 Shiotani et al. ..... 222/67
2004/0195262 A1 10/2004 Hart
2007/0045339 A1 3/2007 Manion
2011/0036864 A1 2/2011 McKenna

* cited by examiner

*Primary Examiner* — Timothy L Maust
(74) *Attorney, Agent, or Firm* — Thorpe North & Western, LLP

(57) ABSTRACT

According to the invention, an adapter is provided to receive and hold a bag-in-box container on top of a conventional water cooler and to control the flow of water from the bag-in-box container into a sealed water reservoir of the water cooler to maintain a desired level of water in the water reservoir. Level control of water in the reservoir is provided by controlling the venting of the sealed reservoir to the atmosphere and/or by controlling the flow of water into the reservoir from the water supply line. Venting control can be through use of a hydrophobic membrane or through use of float valves in the vent, and control of flow of liquid into the reservoir from the water supply line can be by a special float valve that allows high flow capacity at low pressures.

10 Claims, 13 Drawing Sheets

BAG-IN-BOX ADAPTER FOR WATER DISPENSER

BACKGROUND

1. Field of the Invention

The present invention relates generally to water dispensers commonly referred to as water coolers. More particularly, the present invention relates to water dispensers or water coolers wherein a container of water comprising a substantially rigid water bottle is placed on the top of the water dispenser and water is fed by gravity from the water container above the dispenser into a water reservoir in the dispenser wherein the water is cooled or heated by the dispenser and the cooled or heated water can then be dispensed by a user from the dispenser.

2. Related Art

Water dispensers, commonly also referred to as water coolers, are currently in common use throughout the world. With such water dispensers, water is supplied to the water dispenser from a substantially rigid, usually five gallon, water bottle made of glass or plastic and having a narrow neck forming the bottle opening. The bottle is inverted and placed on the top of the dispenser so that water flows by gravity from the bottle opening into a water reservoir in the dispenser where the water is cooled, and in newer water dispensers, a portion of the water is also heated. The cooled or heated water is then dispensed from the dispenser when desired by a user into a cup, glass, or other container for use by the user, usually for drinking. When the water bottle is inverted and placed on top of the water dispenser, the end of the water bottle neck with the opening into the bottle extends into the water reservoir. The flow of water from the water bottle is generally controlled by controlling flow of air into the bottle so that water flow is stopped by a vacuum created in the inside top of the water bottle as water flows from the bottle and air is prevented from entering the bottle. Air flow into the bottle is generally stopped by water in the reservoir reaching and closing the bottle opening in the reservoir when the reservoir is filled to the desired level set by the position of the opening into the bottle with respect to the reservoir. As water is dispensed from the dispenser, the water level in the reservoir goes down below the opening to the bottle and air can enter the bottle to allow additional water to flow from the bottle down into the reservoir until the water in the reservoir again covers the bottle opening to prevent further air flow into the bottle. This water flow control is based upon the rigidity of the water bottle. These rigid water bottles are relatively expensive and are generally reusable. Full water bottles are delivered to the site of the water dispenser and empty water bottles are picked up, refilled, and reused.

Bag-in-box container systems have become widely used as packing and shipping containers for a variety of liquid products such as soft drink syrup, milk, and wine. Such systems include a flexible bag or bladder disposed in a cardboard box such as a corrugated cardboard box. The flexible bag can conform to the shape of the inside of the box when filled with a liquid material. The box provides a fixed container shape for the bag and contents and protects the bag and contents during storage and shipping, and, in many instances, provides a holder for the bag during the dispensing of the contents of the bag. The bag will generally include a dispensing fitting secured thereto which is used to dispense the contents of the bag from the bag. The dispenser can be located at various locations on the bag depending upon the application, such as at the bottom of the bag when positioned in the box when the contents of the bag is to be removed by gravity while the bag remains in the box. In such instance, the box will generally include an area adjacent the dispensing fitting which opens to expose the fitting and allow controlled gravity discharge of the contents of the bag. However, the bag does not provide a rigid container for the liquid and the bag collapses within the box when liquid is removed from the bag. Such bag-in-box containers are usually relatively inexpensive to make and easy to produce and assemble. Therefore, the bag-in-box container is usually disposable and is disposed of after use rather than being saved and refilled. Bag-in-box containers come in various sizes, with many such containers having a five gallon capacity similar to the five gallon water cooler bottles.

Recently, water has become one of the liquids packaged in bag-in-box containers and water can be dispensed directly from the bottom portion of the bag-in-box container similarly to the way wine and milk is dispensed from such containers. Dispensers are being developed for cooling and heating water from bag-in-box containers of water and for dispensing such cooled and/or heated water, see, for example, U.S. Pat. No. 7,975,879. However, because the bags containing the water are not rigid and collapse as the water is dispensed from the bag, such bag-in-box containers with a flexible bag cannot be directly used with the various water dispensers designed for use with five gallon rigid water bottles.

Adapters for adapting a conventional water cooler for use with a flexible bag full of water rather than a rigid water bottle are shown in U.S. Pat. Nos. 6,398,073, 7,331,487, and 8,117,096. These adapters show holders for receiving and holding a flexible bag of water above a water cooler and such holders include a piercing spike in the bottom thereof to pierce the bag as it is dropped into the holder to allow flow of water from the bag through the spike into the water reservoir of the cooler. U.S. Pat. No. 6,398,073 shows a ballcock float valve in the fluid passage from the spike to the reservoir to control the flow of water from the bag into the reservoir and to stop water flow when the level of water in the reservoir reaches a desired level as indicated by the float of the ballcock valve. U.S. Pat. No. 7,331,487 shows a sealed water reservoir with an open vent tube extending upwardly from the reservoir alongside the bag. The vent tube opens to the atmosphere above the top of the bag so that water fills the sealed reservoir and extends up into the vent tube. The water level in the vent tube is equalized with the water level in the bag. U.S. Pat. No. 8,117,096 shows a completely sealed water reservoir formed in the dispenser so that water flows from the bag into the reservoir and out through the dispenser valve. An air vent between the reservoir and the inside of the bag is provided so that air can flow between the sealed reservoir and the inside of the bag to allow water to flow into and substantially fill the sealed reservoir when the bag is initially connected to the reservoir. In this manner, the water cooler reservoir is substantially filled with water so that the water is cooled or heated in the reservoir prior to being dispensed from the dispenser.

The above described bag dispensers all provide bag receiving holders mounted on the top of the water cooler with spikes in the bottom thereof upon which the full water bags are dropped so that the spikes puncture the bottom of the water bag to extend into the water bag to provide fluid communication between the inside of the bag and the fluid reservoir thereby allowing fluid flow from the bag into the reservoir. The spikes are designed so that the bag being punctured seals around the spike to prevent leakage around the spike. While the water filled bags as used in the above described bag dispensers can be packaged and shipped in boxes, if packaged and shipped in boxes, the bags have to be removed from the boxes before used in the water coolers and the large, heavy, and bulky flexible bags full of water have to be removed from the box, lifted above the bag receiving holder mounted on top of the water cooler, and lowered or dropped into the bag receiving holder so that the spikes penetrate the bottom of the bag to allow water to flow into the water cooler reservoir. After use, the empty or almost empty bags have to be retrieved from the bag receiving holder, and if not completely empty, the remaining water from the bag will run into the bag receiving holder when the bag is removed from the spikes and may continuing running as the bag is moved from the holder to its disposal container.

SUMMARY OF THE INVENTION

Applicant has recognized that it would be advantageous to be able to use bag-in-box water containers as replacements for the standard five gallon water bottles currently used in the common water coolers designed for use with such five gallon water bottles. The bag-in-box containers, being disposable, are more economical than the five gallon water bottles. The bag-in-box containers can be easily delivered to the site of such water coolers similarly to the delivery of the water bottles. However, since the bag-in-box containers are disposable, they do not need to be collected and returned for sterilization, refilling, and reuse. In addition, the boxes of the bag-in-box containers generally have openings in the sides thereof which serve as handles for picking up and lifting the bag-in-box containers which make it easier to lift the bag-in-box containers to place them on top of the standard water coolers. In addition, since the box of the bag-in-box container holds the flexible bag, a separate bag receiving holder is not required on the top of the water cooler so the bag-in-box container does not have to be lifted as high as the bag does to be placed in a bag receiving holder mounted on top of the water cooler. Further, a dispensing fitting secured to the bag in the bag-in-box container can include a valve so that the dispensing fitting can be attached to a hose leading into the water cooler receptacle and the valve can be opened after the attachment, and can be closed before disconnection of the fitting and removal of the bag-in-box container from the water cooler for disposal. Therefore, the bag-in-box containers are easier to use than the five gallon water bottles which need to be lifted and inverted for insertion into the cooler and are easier to use than a flexible water bag that needs to be lifted above the bag holders and dropped into the holders and then removed from the holders without being closed. The bag-in-box containers are also more economical than the five gallon bottles.

According to the invention, an adapter is provided to receive and hold a bag-in-box container on top of the water cooler and to control the flow of water from the bag-in-box container into the water reservoir of the water cooler and to maintain a desired level of water in the water reservoir of the water cooler. The adapter includes a water supply line to be connected to an outlet of the bag in the bag-in-box container to allow water to flow from the bag into the water cooler reservoir. The adapter also provides control for the flow of water from the bag into the reservoir and for maintaining a desired level of water in the reservoir. If not already provided with a sealed water reservoir, the adapter seals the water reservoir. Water flow into and level control of water in the reservoir is provided by controlling the venting of the sealed reservoir to the atmosphere, by controlling the flow of water into the reservoir from the water supply line, or by a combination of both. Examples of control of the of the venting of the sealed reservoir to the atmosphere can be through the use of hydrophobic membrane materials at the entrance to a reservoir vent positioned at the desired level of water in the reservoir which will allow air to flow through the membrane but not allow water to flow through the membrane, or through the use of float valves in the vent, and examples of control of the flow of water into the reservoir from the water supply line is a special float valve that allows high flow capacity at low pressures.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENTS

Figure 1:
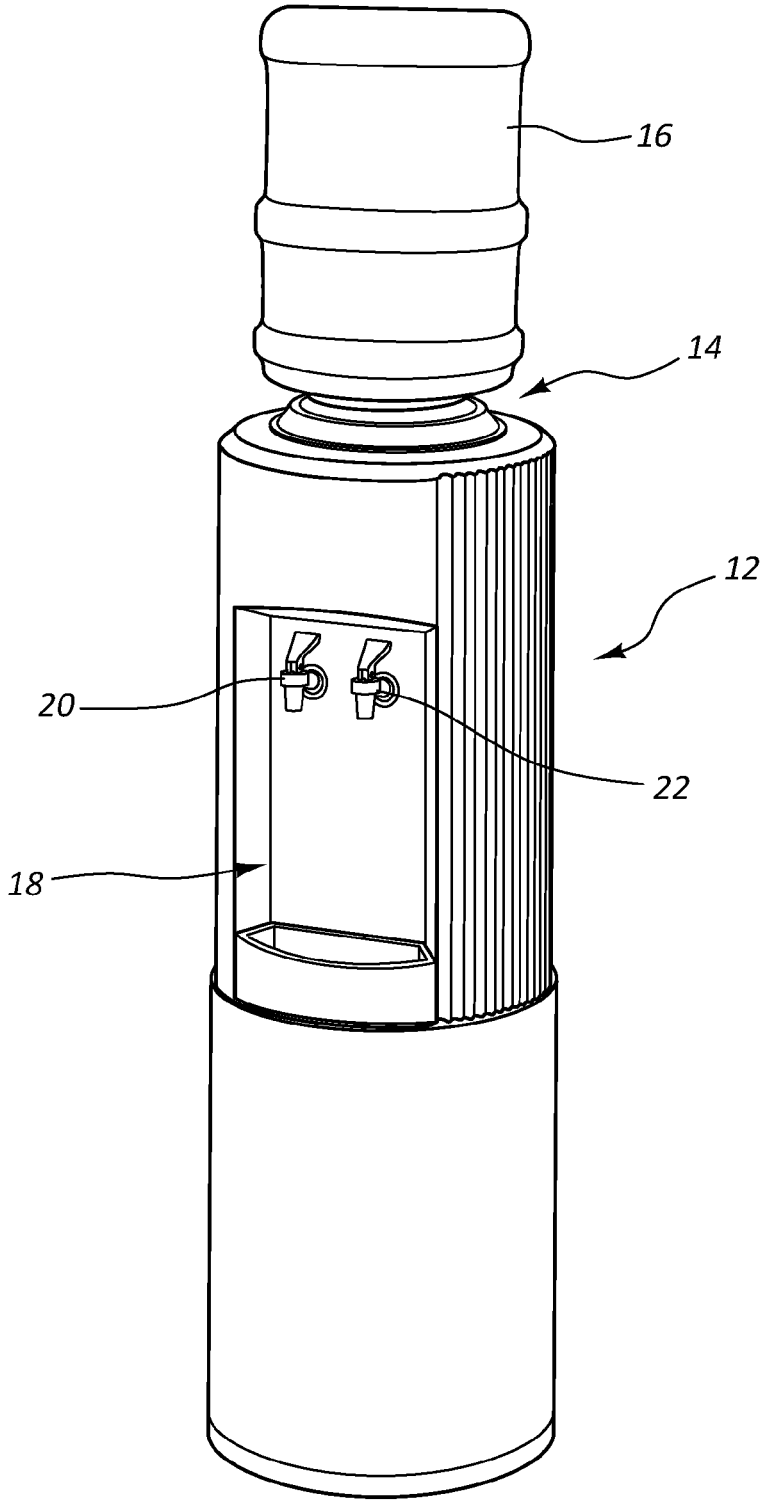
FIG. 1 (Prior Art)
FIG. 1 is a pictorial view of a prior art water cooler with which the adapter of the invention can be used.
Figure 2:
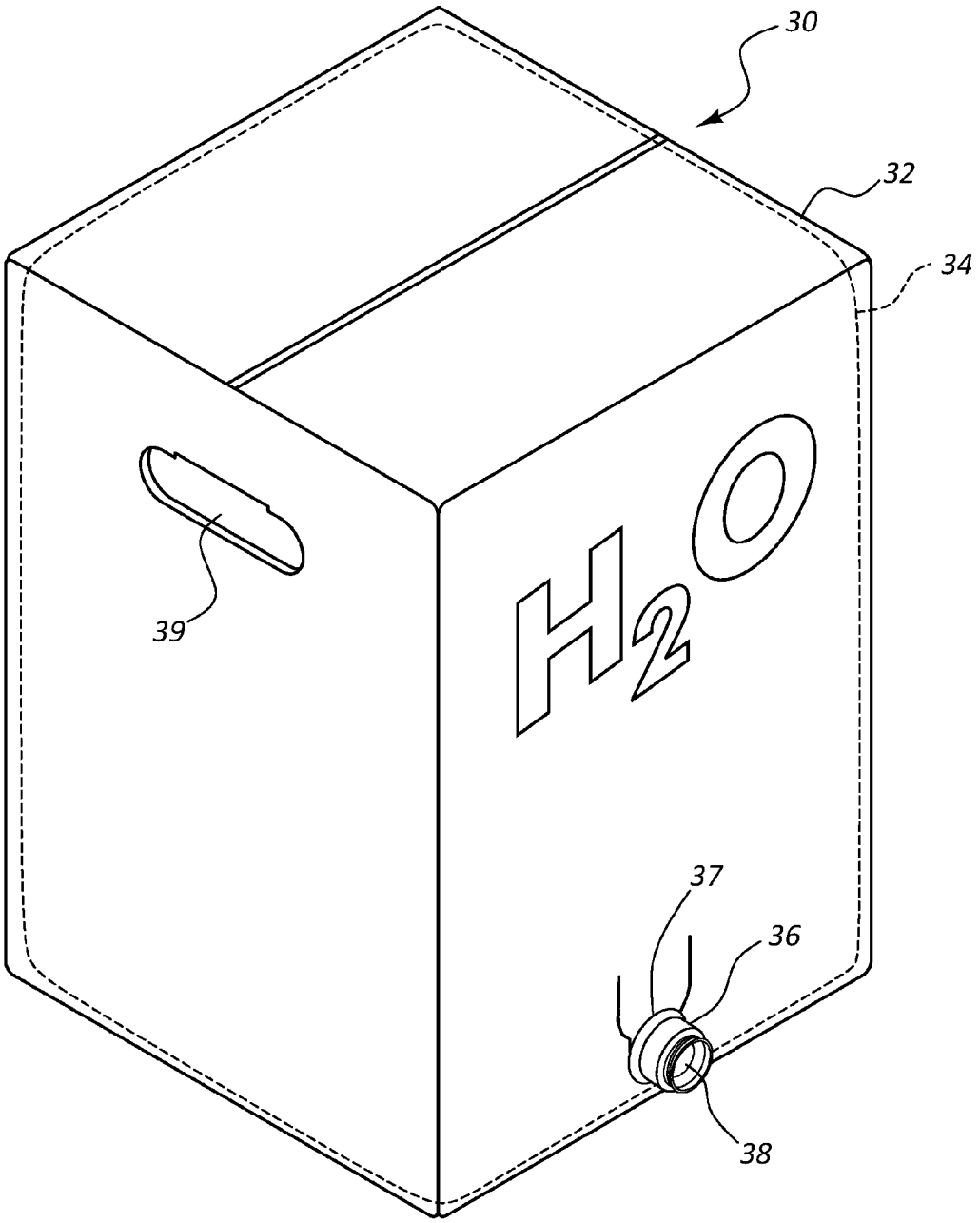
FIG. 2 (Prior Art)
FIG. 2 is a pictorial view of a prior art bag-in-box water container which can be used with the adapted of the invention.
Figure 3:
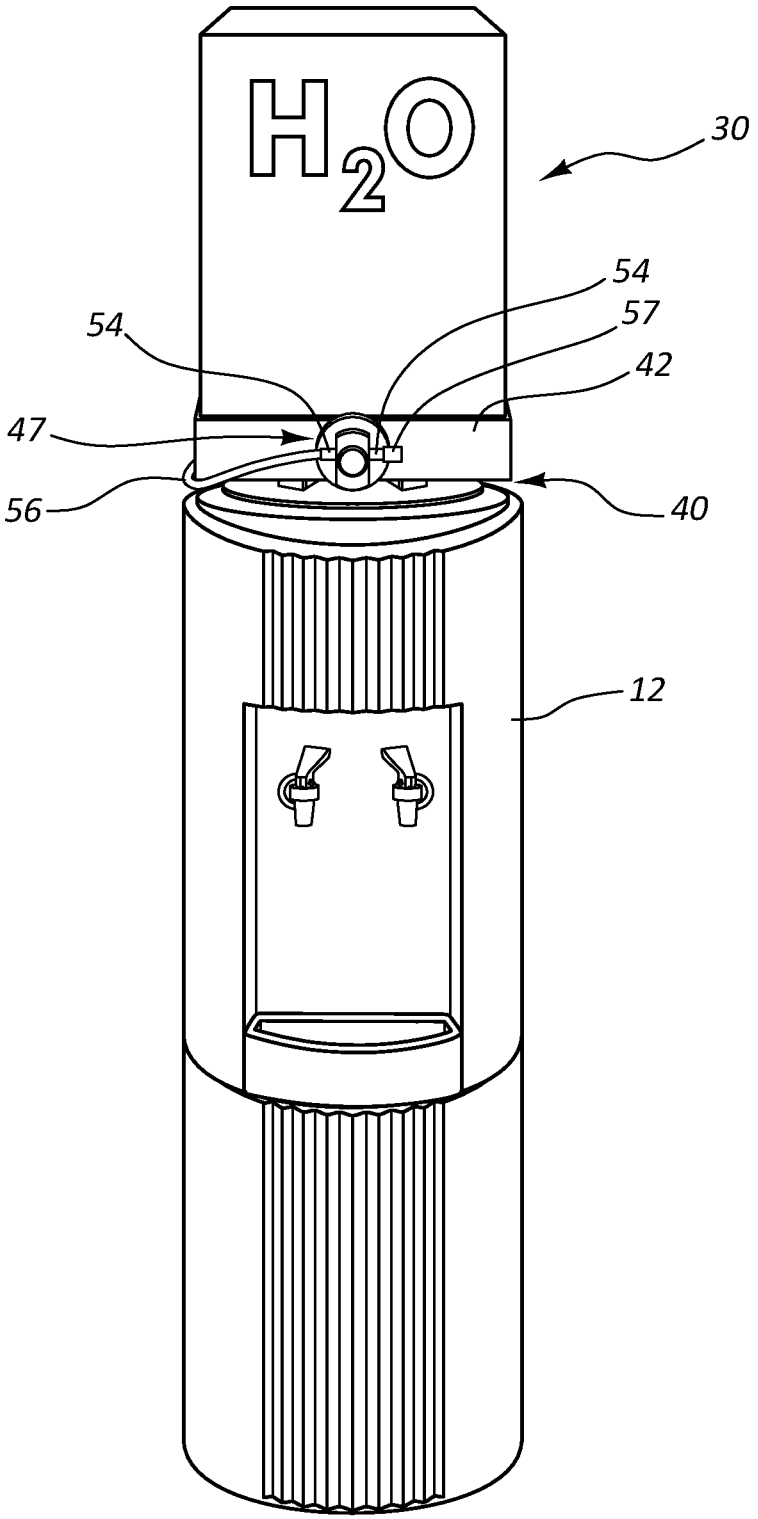
FIG. 3 is a pictorial view of the water cooler of FIG. 1 with the adapter of the invention installed thereon and showing a bag-in-box container as shown in FIG. 2 mounted on the adapter.

The invention is an adapter for use with standard prior art water coolers that use five gallon rigid water bottles as the water supply to allow the water cooler to use a bag-in-box water container rather than the rigid five gallon water bottle. An adapter of the invention can be configured for use with various models and brands of prior art water coolers with minor modifications that will be obvious to those skilled in the art and without departing from the inventive aspects described herein. For purposes of this detailed description, an example of the invention will be illustrated and described for use with Glacier Series Bottled Water Coolers manufactured by Crystal Mountain Products Ltd. having an office in Edmonton, Alberta, Canada. Such bottled water coolers are readily available in the United States and are similar to most bottled water coolers commercially available in the United States and in most other parts of the world. FIG. 1 shows a Glacier Series Bottled Water Cooler as available from Crystal Mountain Products Ltd. As shown, the water cooler includes a water cooler body 12 which rests on a supporting surface, such as a floor, and includes a water bottle support assembly 14 forming the top of water cooler body 12, and which is positioned over an open topped water reservoir, not shown in FIG. 1, inside the top portion of the water cooler body 12. Water bottle support assembly 14 receives and supports a five gallon rigid water bottle 16 in inverted position (water bottle neck and opening facing downwardly) on the top of water cooler body 12. The parts of one embodiment of the water bottle support assembly of the prior art Glacier Series Water Cooler, referred to as the DryGuard™ Assembly, are shown in prior art U.S. Pat. No. 7,051,902, incorporated herein in its entirety by reference. FIGS. 2 and 3 of the referenced U.S. Pat. No. 7,051,902 show the water bottle 16 in inverted position above the water bottle support assembly 14 ready to be lowered into its supported position shown in FIG. 1 hereof. Water cooler body 12 also includes a recessed portion 18 with cooled water discharge valve 20 and hot water discharge valve 22 accessible to a user to allow a user to fill a container, such as a cup, with either cooled water or heated water from the cooler reservoir.

FIG. 2 shows a bag-in-box water container 30 which includes a box 32 having a flexible bag 34 therein, shown in broken lines, and a dispensing fitting in the form of a spout fitment 36, located at the bottom of the bag 34 within the box 32 and extending out of an opening 37 in a side of the box adjacent its bottom. There are a number of different dispensing fittings currently in use with bag-in-box containers, the one being illustrated as an example in the illustrated embodiment is a multiple part dispensing fitting made by Liqui-Box Corporation of Worthington, Ohio, as shown in U.S. Pat. Nos. 4,421,146 and 4,445,551, both incorporated herein in their entirety by reference. With this Liqui-Box dispensing fitting, the bag 34 in the bag-in-box container 30 includes the spout fitment 36 sealingly secured to the bag 34. The spout fitment 36 includes a normally closed spout valve member 38 therein which is normally closed to prevent flow of water out of the bag through the spout fitment 36. The bag 34 contained in the box 32 includes this spout fitment 36 and the normally closed spout valve member 38. The spout fitment 36 is positioned inside the box 32 until the bag-in-box container 30 is ready to be used. When ready to be used, the spout fitment 36 is pulled out of the box 32 through opening 37 so as to extend through opening 37 outwardly from the box 32, as shown. Box 32 will usually include handle openings 39 in opposite sides which a user can use to lift and move the bag-in-box container.

FIG. 3 shows applicant's adapter, indicated generally as 40, positioned on the top of the Glacier Water Cooler body 12, in place of the prior art water bottle support assembly 14, and mounting a five gallon bag-in-box water container 30 on top of the Glacier Water Cooler body 12 in place of the five gallon rigid water bottle 16 shown in FIG. 1. The bag-in-box water container 30 is mounted on and received by an adapter bag-in-box water container support tray 42 sized and configured to receive and support the bag-in-box container 30 thereon. The illustrated support tray 42 includes back and side tray flanges 44, FIGS. 4, 5, and 7, and front tray flange 45 to hold the bottom of the bag-in-box container 30 received on tray 42 from sliding off of tray 42. The front tray flange 45 includes a slot 46.

Figure 7:
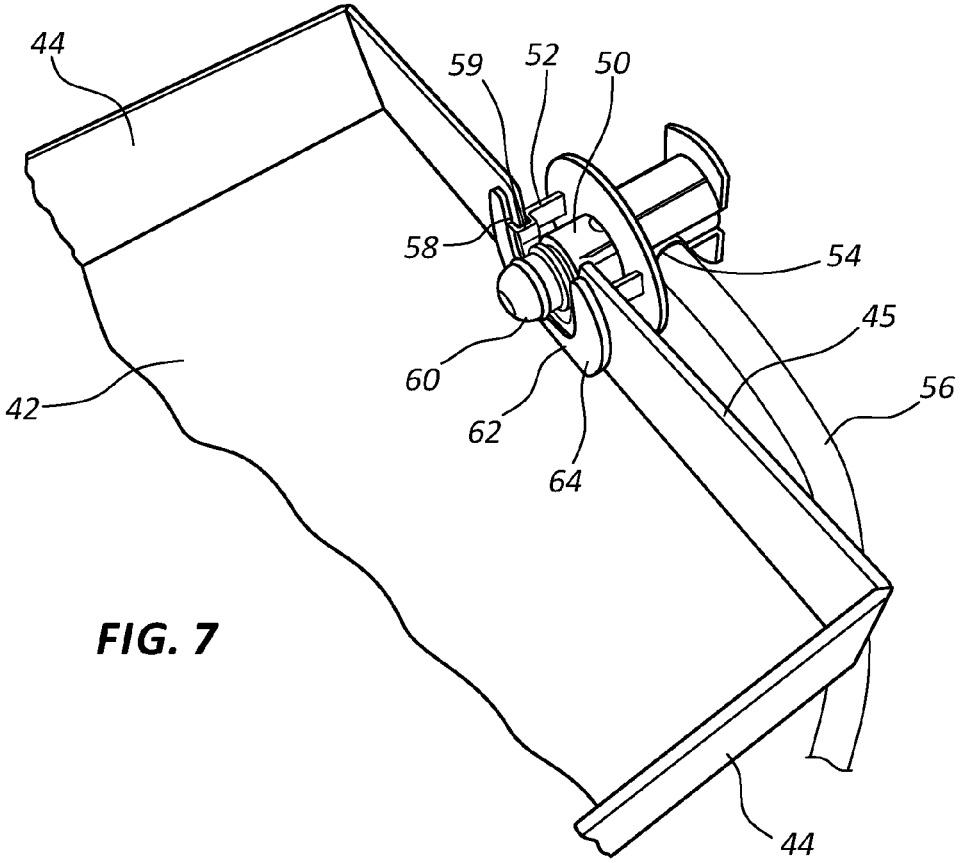
FIG. 7 is a fragmentary pictorial view of a portion of the bag-in-box receiving tray of the adapter of the invention and also showing a dispensing fitting adapted to mate with a discharge fitment in the bag of the bag-in-box container to attach the bag of the bag-in-box container to the adapter supply hose.

As indicated above in connection with the bag-in-box container 30 shown in FIG. 2, bag 34 includes spout fitment 36 as part of a Liqui-Box multiple part dispensing fitting indicated generally in FIG. 3 as 47. When bag-in-box container 30 is ready to be placed on bag-in-box container supporting tray 42, spout fitment 36 is pulled out of the box 32 through opening 37 so as to extend from box 32. A separate service line connector 50, FIG. 7, is slidably mounted in a spout clamp 52 and includes two line connectors 54 to connect to service lines to be supplied with water flowing from the bag 34. In the present application, only one of the two line connectors is connected to a supply line, here shown as supply line 56 with the other line connector capped by cap 57. The end portion 58 of spout clamp 52 away from the line connectors is adapted to connect to the extended end of the spout fitment 36 and includes a groove 59 that can slide into slot 46 of front tray flange 45 to hold and stabilize spout clamp 52 and the attached spout fitment 36 extending from the bag-in-box container 30 with respect to adapter bag-in-box water container support tray 42. When mounted in spout clamp 52, service line connector 50 can slide with respect to spout clamp 52 between an extended position wherein the normally closed spout valve member 38 in the spout fitment 36 remains in normally closed condition to prevent flow of water out of the bag, and a retracted position wherein service line connector 50 is pushed along spout clamp 52 toward the bag-in-box container causing end 60 of service line connector 50 to be pushed into fitment spout 36 and to open the normally closed spout valve member 38 to allow the water to flow from bag 44, through the spout fitment 36 into the service line connector 50 and through line connectors 54 into any service lines connected thereto. This operation is all as described in the cited prior art U.S. Pat. No. 4,421,146.

Figure 4:
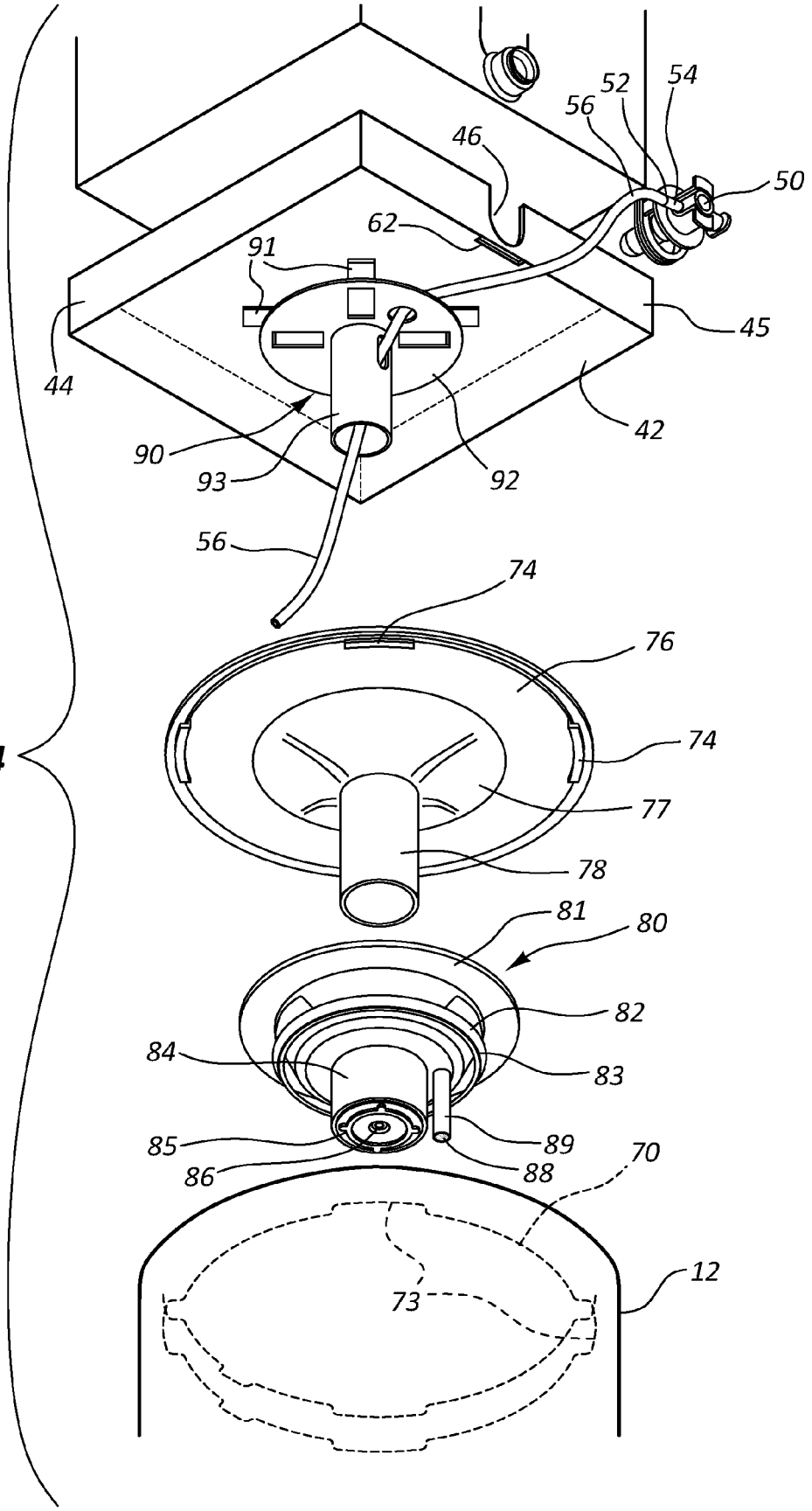
FIG. 4 is a an assembly view showing the parts of the adapter of the invention as they fit into the top of the water cooler of FIG. 1.
Figure 5:
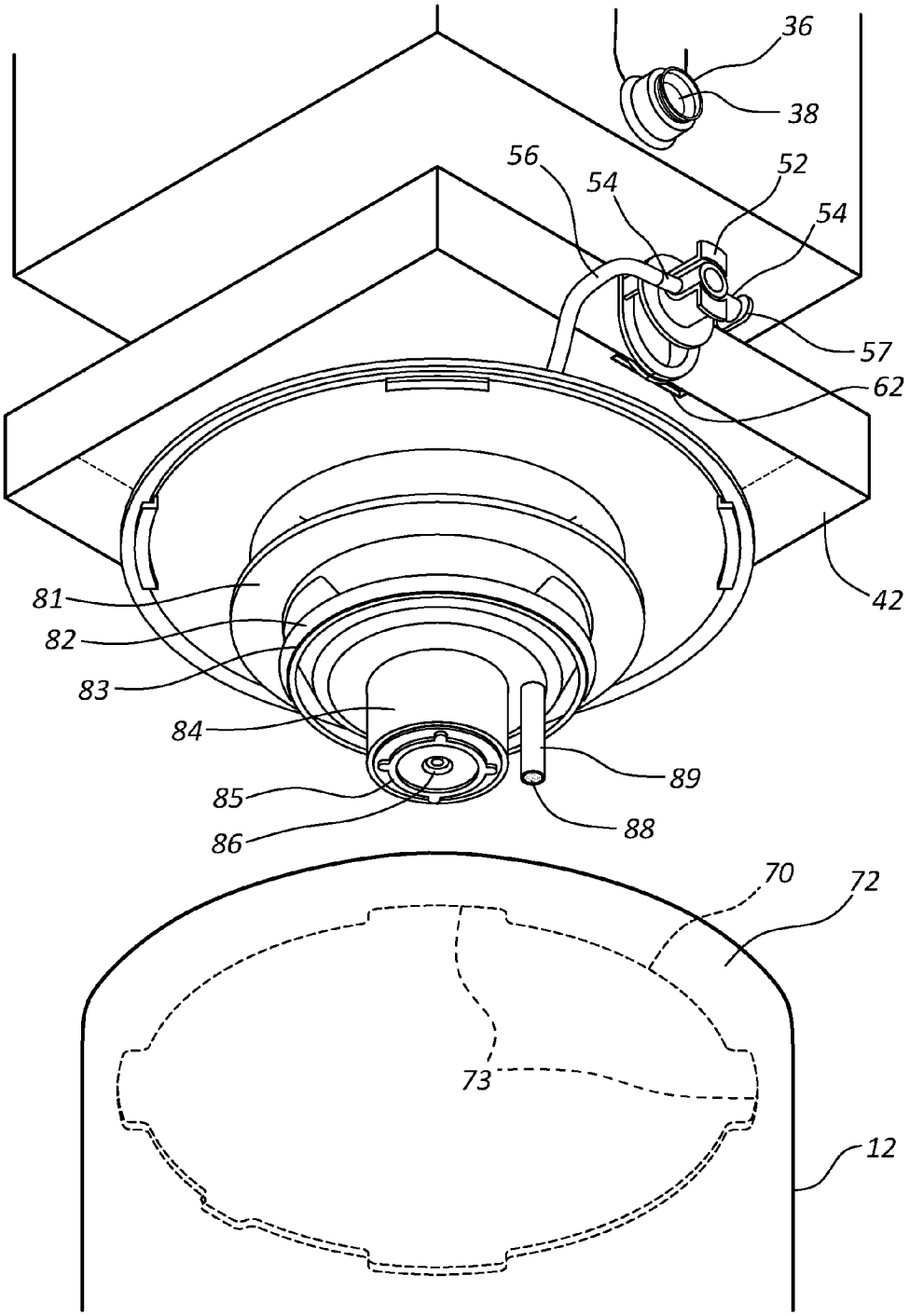
FIG. 5 is an assembly view similar to that of FIG. 4, but showing several of the parts shown in FIG. 4 in assembled condition ready for insertion into the top of the water cooler of FIG. 1.
Figure 6:
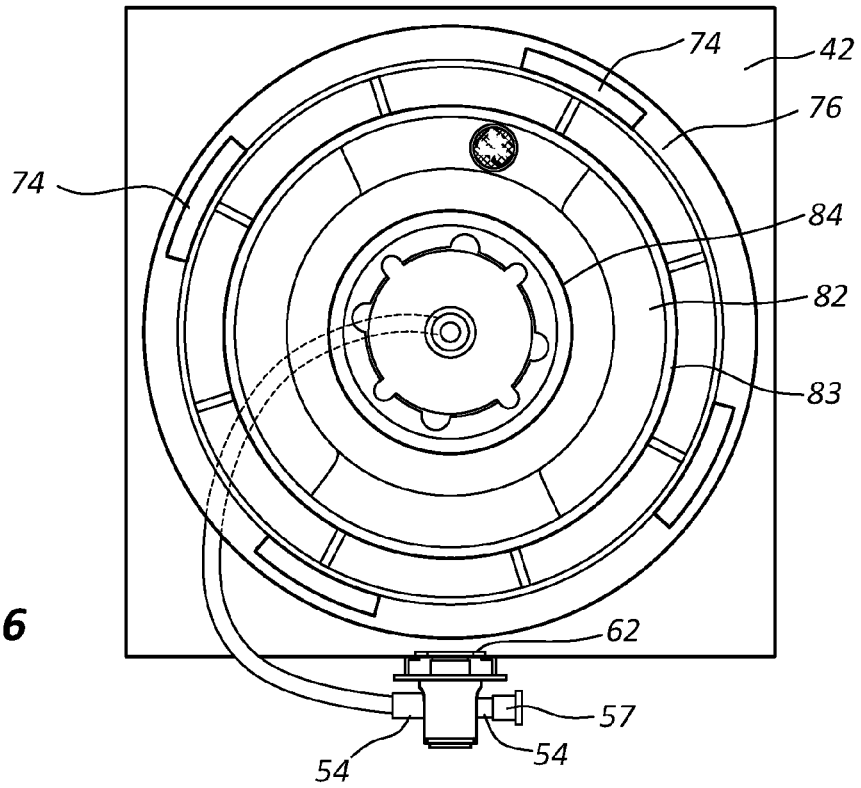
FIG. 6 is a bottom plan view of the assembled parts shown in FIGS. 4 and 5.

With this illustrated Liqui-Box dispensing fitting embodiment of the dispensing fitting 47, the spout clamp 52 with service line connector 50, as shown in FIGS. 4, 5, and 7, is reusable. Spout clamp 52 is disconnected from the spout fitment 36 extending from bag 34 when a bag 34 is empty and is connected to a new bag spout fitment 36 extending from a full bag 34 of a replacement bag-in-box container 30.

The adapter of the present invention includes the adapter supply line 56 adapted to connect to an outlet of dispensing fitting 47 to thereby connect the bag of the bag-in-box container with the adapter. With adapter supply line 56 connected to the outlet of the dispensing fitting 47, dispensing fitting 47 can be operated to allow water from the bag-in-box container to flow into adapter supply line 56 and to flow through adapted supply line 56 through the adapter and into the water cooler reservoir. For use with the described Liqui-Box dispensing fitting, the adapter supply line 56 is connected to one of the line connectors 54 of service line connector 50, as shown in, for example, FIGS. 4-7. With the adapter supply line 56 connected to one of a line connector 54, and with the spout clamp 52 connected to spout fitment 36 extending from the bag-in-box container, the service line connector 50 can be moved along spout clamp 52 toward the bag-in-box container in receiving tray 42 to open the spout valve 38 in the spout fitment 36 to allow water from the bag 34 to flow through service line connector 50 and line connector 54 into adapter supply line 60 and through adapter supply line 56 into the water cooler. With this illustrated Liqui-Box dispensing fitting embodiment of the dispensing fitting 47, the bottom of support tray 34 includes a slot 62, FIGS. 4-7, immediately adjacent the front tray flange 45 at the bottom of front tray slot 46 to receive the lower portion of flange 64, FIG. 7, of spout clamp 52 therein to allow spout clamp 52 to be properly positioned at the bottom of the bag in the bag-in-box container. This slot 62 may not be necessary, or may need to be modified, depending upon the dispensing fitting used with the bag-in-box container used.

The general construction of the top of the example Glacier Series water cooler shown in FIG. 1 is illustrated in FIGS. 2 and 3 of referenced U.S. Pat. No. 7,051,902 and shows a water reservoir positioned in the top of the water cooler body 12. FIGS. 4 and 5 herein show water cooler body 12 with top opening 70 above the open top water reservoir, not shown, and forming the open top of the water reservoir. Top opening 70 is encircled by top rim 72 of body 12. Top rim 72 includes receiving recesses 73 for receiving locking tabs 74 extending from top cover 76. Top cover 76 fits over top opening 70 and the edge of top rim 72 with locking tabs 74 initially fitting into receiving recesses 73, and top cover 76 is then rotated to move locking tabs 74 from receiving recesses 73 to a position under top rim 72 to lock top cover 76 in position in the top of body 12. Top cover 76 includes a downwardly extending substantially cone shaped center portion 77 with a lower central cylindrical portion 78 extending further downwardly as shown in FIG. 4. In the prior art embodiment of the water cooler as shown in FIG. 1, the substantially downwardly extending cone shaped center portion 77 receives and supports the top of the rigid water bottle 16 with the narrow neck of the rigid bottle extending into lower central cylindrical portion 78.

The downwardly extending cone shaped center portion 77 and lower central cylindrical portion 78 fit into a reservoir seal assembly 80, FIGS. 4 and 5. Reservoir seal assembly 80 includes a top ring portion 81 which abuts the bottom surface of top cover 76 when cone shaped center portion 77 and lower central cylindrical portion 78 of top cover 76 are received in reservoir seal assembly 80, and a sealing ring 82 with seal 83, FIGS. 4, 5, and 6, that bears against the interior surface of the reservoir when the seal assembly 80 is received into the open upper end of the reservoir. A central cylindrical extension 84 extends downwardly into the reservoir when the sealing assembly is positioned in the open top of the reservoir. The bottom of central cylindrical extension 84 is sealed by bottom fitting 85 which is sealingly secured in the bottom of central cylindrical extension 84, and includes a water inlet 86. In the prior art embodiment of the water cooler as shown in FIG. 1 (and as shown in detail in FIGS. 2 and 3 of referenced U.S. Pat. No. 7,051,902), bottom fitting 85 included a pin for engaging the cap of the rigid water bottle which is received in central cylindrical extension 84 to connect water inlet 86 to the inside of water bottle 16 so that water from water bottle 16 can flow from water bottle 16 through water inlet 86 into the water reservoir. With the adapter of the present invention, water inlet 86 communicates with supply line 56 so that water from the bag-in-box container flows from the bag-in-box container through supply line 56 and through water inlet 86 into the water reservoir. A small air vent 88 extends through sealing ring 82, which for the illustrated embodiment of the present invention, is shown as extended from sealing ring 82 into the reservoir by means of air vent tube 89. It should be noted that, except for the air vent 88, the bottom of the reservoir seal assembly 80 is completely sealed from seal 83 in sealing ring 82 to water inlet 86. Therefore, the water reservoir is completely sealed except for the air vent 88 and the water inlet 86. Access to the reservoir is restricted to the flow of water into the reservoir and flow of air into and out of the reservoir through air vent 88.

Bag-in-box water container tray 42 is secured to and spaced above mounting fitting 90 by legs 91 extending from mounting disc 92. Legs 91 may be welded to the bottom of tray 42 or otherwise attached in any suitable manner to the bottom of tray 42. Mounting tube 93 extends downwardly from mounting disc 92. Mounting disc 92 is sized to fit into the top portion of downwardly extending cone shaped center portion 77 of top cover 76 with mounting tube 93 extending into lower central cylindrical portion 78. Supply line 56 extends from connection to a line connector 54, between the bottom of tray 42 and the top of mounting disc 92 through opening 94 in mounting disc 92 and opening 95 in mounting tube 93, through mounting tube 93 into and through lower central cylindrical portion 78 of top cover 76, into central cylindrical extension 84 of sealing assembly 80 to where supply line 56 attaches to bottom fitting 85 and water inlet 86. Thus, when dispensing fitting 47 is attached to bag 34, water from bag 34 can flow from bag 34 into the water cooler reservoir.

FIGS. 8A-8E show a schematic cross section representative of a water cooler water reservoir 100 with a reservoir seal assembly 102 therein showing a seal 104 between the inner surface 106 of the water reservoir 100 and the reservoir seal assembly 102, and with supply line 108 extending into seal assembly 102 and connecting to bottom fitting 110 so as to be connected to the water outlet through bottom fitting 110 into the water reservoir 100. Air vent tube 112 extends from air vent passage 114, which vents through a vent fitting 115 extending through seal assembly sealing ring 116, to communication with the atmosphere through air filter 118. FIGS. 8A-8E illustrate several embodiments of water flow and level control for reservoir 100.

Figure 8A:
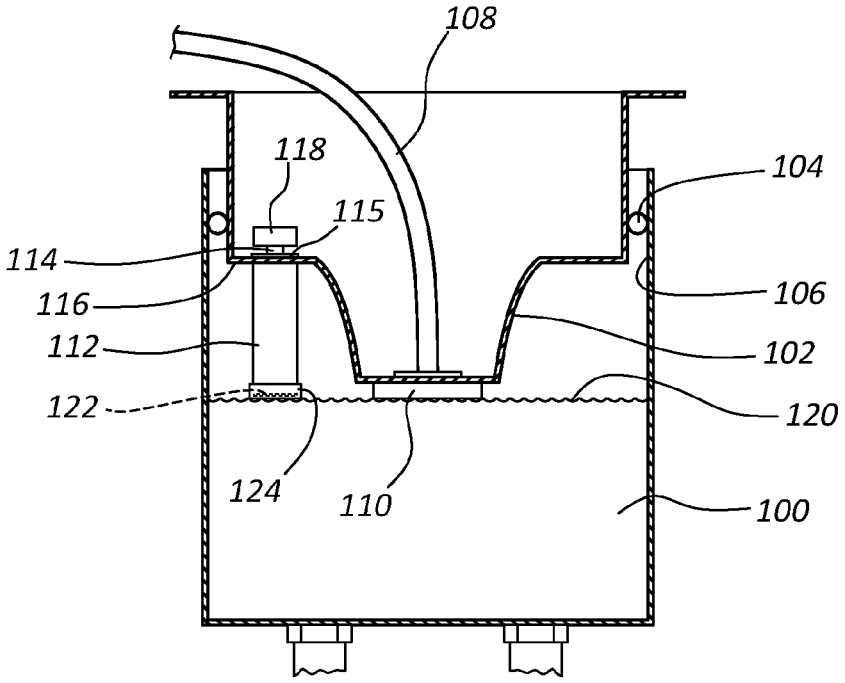
FIG. 8A is a simplified schematic vertical section representing the adapter of the invention installed in the top of the water cooler reservoir and showing a hydrophobic membrane embodiment for control of the venting of the reservoir.
Figure 9A:
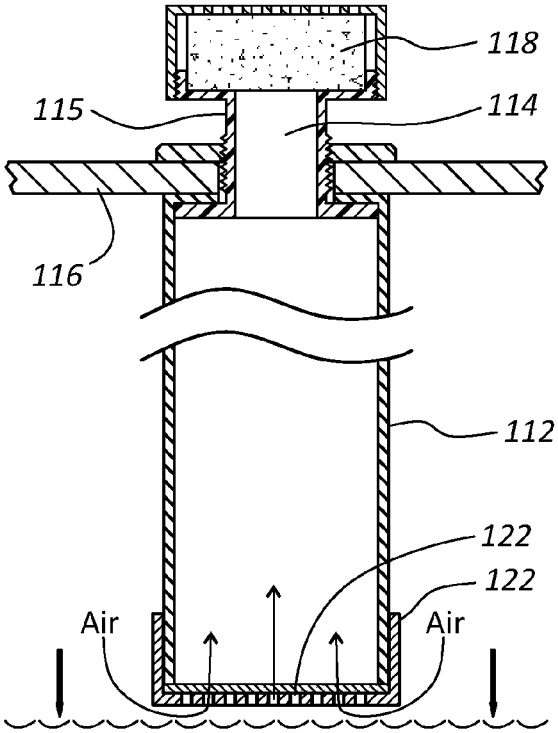
FIG. 9A is a vertical section showing details of the hydrophobic membrane embodiment for control of the venting of the reservoir with the water level below the membrane.
Figure 9B:
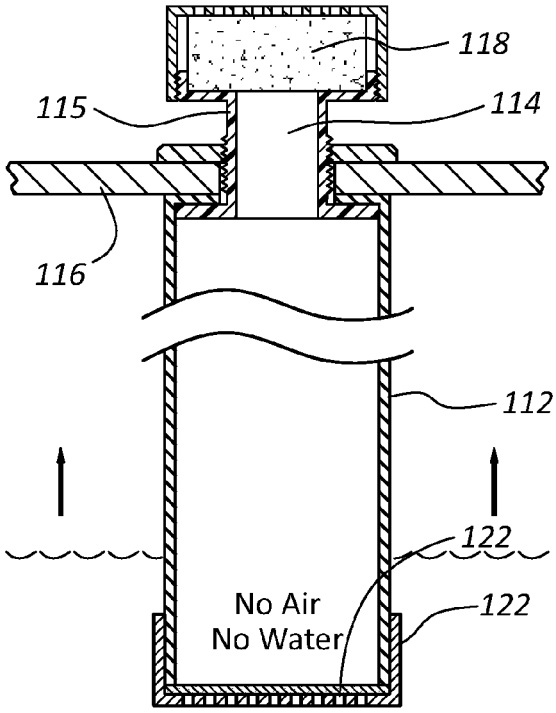
FIG. 9B is a vertical section showing details of the hydrophobic membrane embodiment for control of the venting of the reservoir similar to that of FIG. 9A but with the water level above the membrane.

FIG. 8A shows the water outlet through bottom fitting 110 discharging directly into water reservoir 100. The flow of water into reservoir 100 and the level 120 of water in reservoir 100 is controlled by a hydrophobic membrane material 122 held at the entrance of vent tube 112 by ring 124, see also FIGS. 9A and 9B. Hydrophobic membrane material 122 is a material through which gas, such as air, can flow, but through which a liquid, such as water, cannot flow. An example of such material is an Emflon II Membrane material available from Pall Corporation, Port Washington, N.Y. In this embodiment, when the water level is below the membrane material 122, air can escape from the reservoir through the membrane and air vent to allow water to flow into the reservoir. When water covers the membrane material, air can no longer flow through the air vent because it is blocked by the water and water cannot flow through the membranes material so cannot flow out the vent. Depending upon the amount of water in the bag of the bag-in-box container, a small amount of water may continue to flow into the reservoir once the water level reaches the membrane and vent outlet as the air pressure builds up in the sealed area of the reservoir above the water to equalize with the atmospheric pressure acting on the bag and water in the bag. As water is dispensed from the reservoir and the water level drops below the membrane so that air can again pass through the membrane, water will again flow from the bag into the reservoir.

Figure 8B:
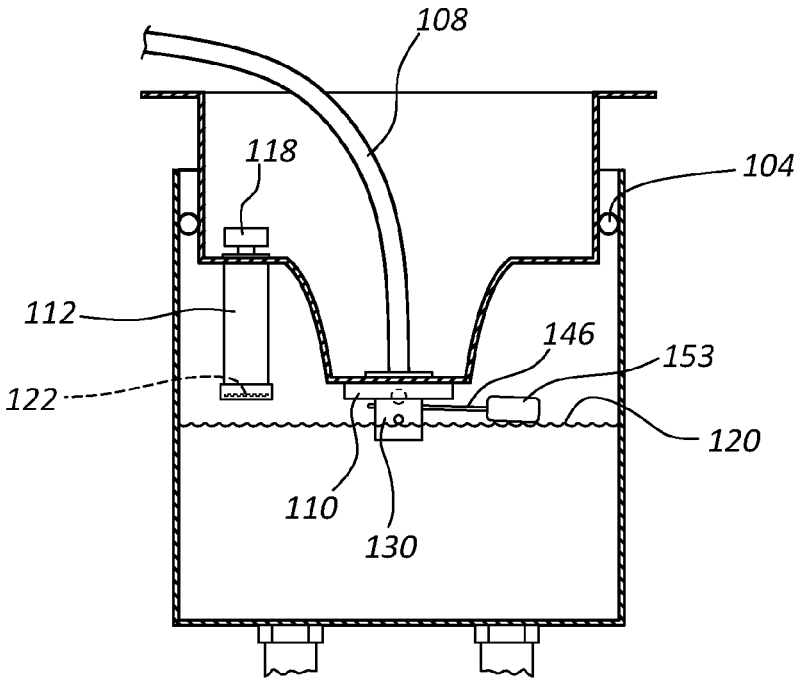
FIG. 8B is a simplified schematic vertical section similar to that of FIG. 8A showing a special float valve that allows high flow capacity at low pressures from the water supply line into the reservoir when the water level in the reservoir is below the desired level in combination with the hydrophobic membrane embodiment for control of the venting of the reservoir.
Figure 12A:
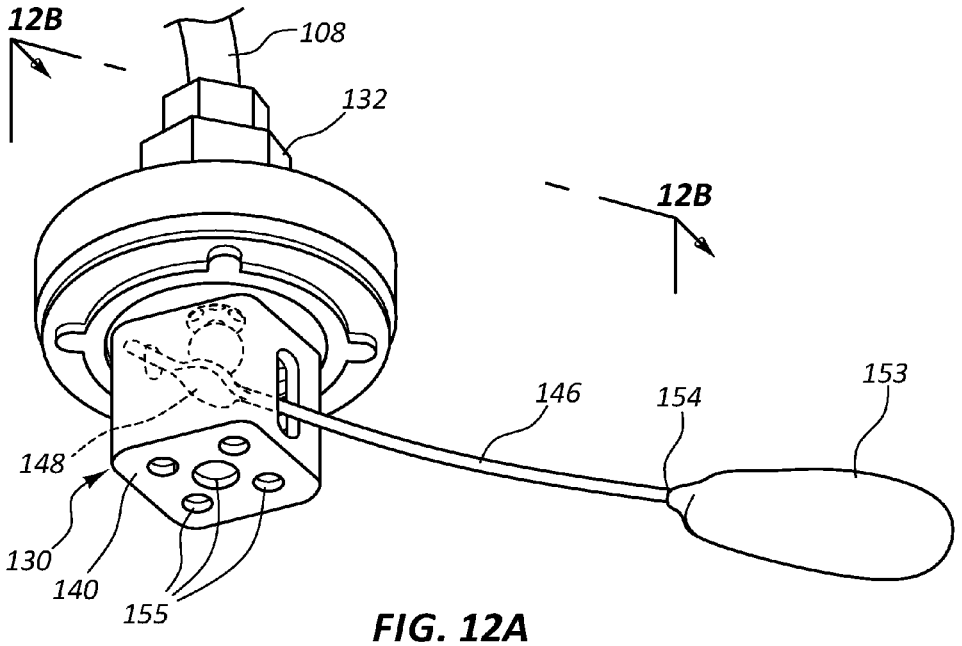
FIG. 12A is a pictorial view of a float valve of the invention.
Figure 12B:
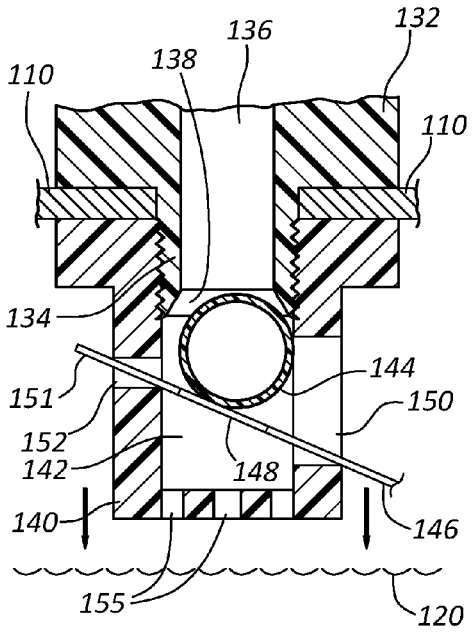
FIG. 12B is a vertical section taken on the line 12B-12B of FIG. 12A showing the water level below the valve housing.
Figure 12C:
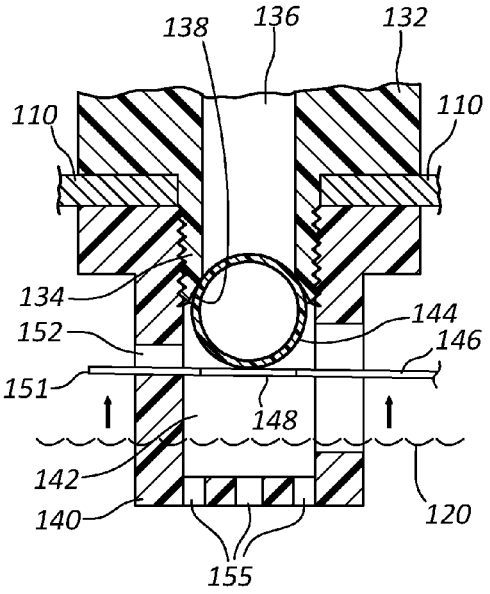
FIG. 12C is a vertical section similar to that of FIG. 12B showing the water level above the bottom of the valve housing.

FIG. 8B shows the flow of water into reservoir 100 and the level 120 of water in reservoir 100 controlled by controlling the flow of water from the water inlet into the reservoir. In the illustrated embodiment of this control, a float valve 130 is provided at the water inlet 110 to the reservoir. Details of the float valve 110 are shown in FIGS. 12A, 12B, and 12C. Water outlet fitting 132 with threaded nipple 134 is secured to the end of supply line 108. Threaded nipple fits through an opening in bottom fitting 110. Inlet passage 136 extends through outlet fitting 132 and nipple 134 with a ball seat 138 at the end of nipple 134. Float housing 140 forming float chamber 142 is screwed onto the end of nipple 134 after ball 144 has been placed in float chamber 142. Float rod 146 with enlarged flattened portion 148 is inserted through slot 150 so that end 151 of float rod 146 extends through opening 152 of float housing 140 and enlarged flattened portion 148 is positioned under ball 144. Float 153 is attached to end 154 of float rod 146. Float 153 is of somewhat flattened configuration oriented similarly with float rod flattened portion 148 so that float 153 will tend to float in flattened orientation on top of the water in reservoir 100. This will tend to keep float rod flattened portion 148 in flattened orientation under ball 144, and will keep float rod flattened portion in float chamber 142 as flattened portion will not pass through slot 150. Float rod 146 can be rotated to align float rod flattened portion 148 with slot 150 to insert or remove the float rod from float chamber 142. As can be seen from FIG. 12B, when the water level 120 in water reservoir 100 is below the bottom of float housing 140, float 153, which floats substantially at water level, is below the bottom of float housing 140, and float rod is in the position shown in FIG. 12B with ball 144 below ball seat 138 so that the valve is open and water is free to flow through inlet passage 136, float chamber 142, and holes 155 in float chamber bottom into the reservoir 100. As the water level rises in reservoir 100, float 153 rises with it until it reaches the position shown in FIGS. 8B and 12C with float rod 146 in the position shown in FIG. 12C. In this position, ball 144 has been raised against ball seat 138 to close inlet passage 136 and stop flow of water into reservoir 100. Unlike a ballcock valve which has restricted slow flow through the valve, particularly at low pressure, this valve arrangement provides a large flow passage when open to allow large flow volume at low pressure. Further, because of this low pressure, the upward float pressure on float rod 146 and flattened portion 148 is sufficient to provide enough upward pressure on ball 144 against valve seat 138 to stop the flow of water into the reservoir.

As shown in FIG. 8B, in addition to float valve 130 which controls the water flowing into the reservoir and the level of the water in the reservoir, the vent tube 112 with hydrophobic membrane 122 as described for FIG. 8A is still present. While a vent to allow air to flow into and out of the reservoir as the water level varies between the desire level and lower levels is necessary, the hydrophobic membrane is not necessary because the float valve controls the water flow and water level. However, the presence of the hydrophobic membrane provides a safety feature in that if float valve 130 fails to operate for any reason, the hydrophobic membrane over the air vent will stop filling of the reservoir at substantially the level of the membrane to prevent a water overflow from the reservoir through the air vent.

Figure 8C:
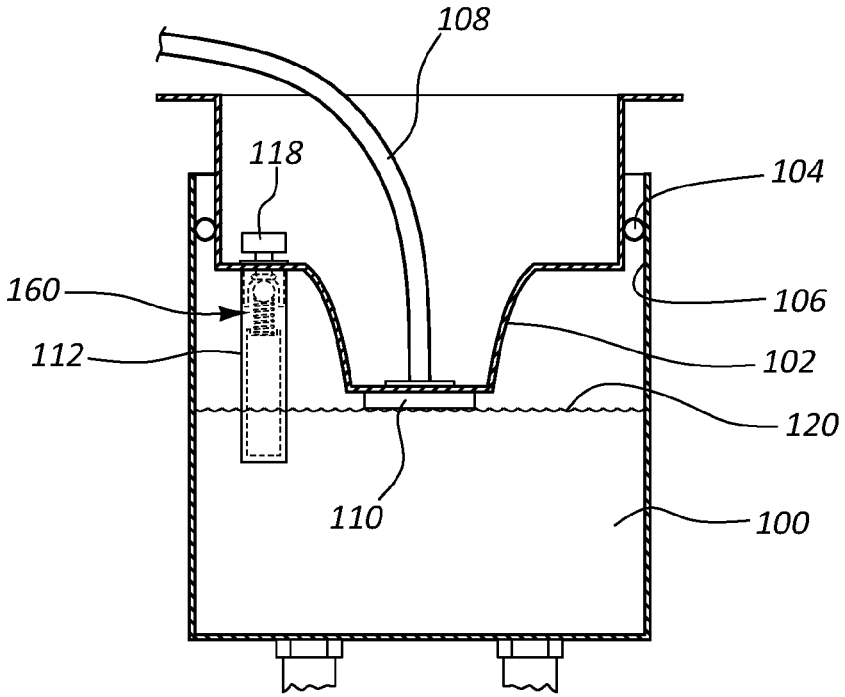
FIG. 8C is a simplified schematic vertical section similar to that of FIG. 8A showing a float valve embodiment for control of the venting of the reservoir.
Figure 11A:
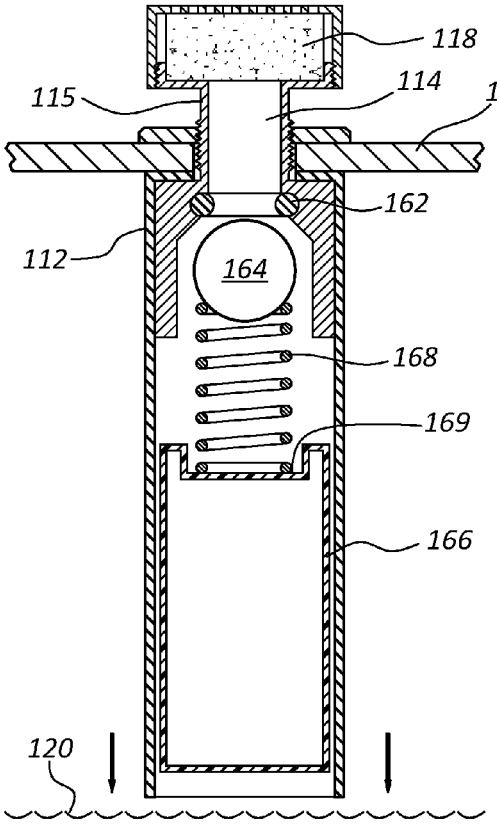
FIG. 11A is a vertical section showing details of the float valve embodiment for controlling the venting of the reservoir as shown in FIG. 8C with the water at a level in the reservoir to close the valve.
Figure 11B:
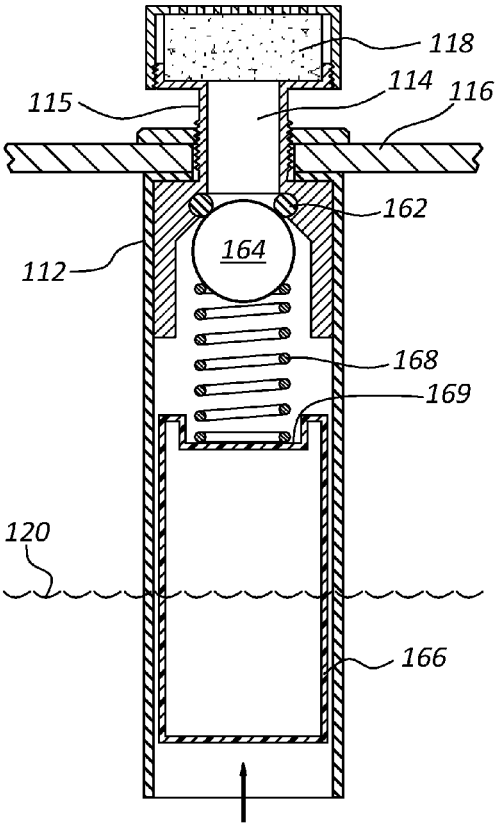
FIG. 11B is a vertical section showing details of the float valve embodiment for controlling the venting of the reservoir as shown in FIG. 8C with the water at a level in the reservoir to close the valve.

FIG. 8C shows the water outlet through bottom fitting 110 discharging directly into water reservoir 100 as shown for FIG. 8A. The flow of water into reservoir 100 and the level 120 of water in reservoir 100 is controlled by a float valve 160 in vent tube 112 which opens and closes the air vent into the reservoir. In the illustrated embodiment of this control, shown in more detail in FIGS. 11A and 11B, air vent passage 114, which vents through vent fitting 115 extending through seal assembly sealing ring 116, includes a seal, such as an O-ring 162, at the lower end of air vent passage 114 to form a ball seat for ball 164. A float 166 is slidably positioned in vent tube 112, with a spring 168 between a float upper end recess 169 and ball 164. As shown in FIG. 11A, when the water level 120 in reservoir 100 is below the bottom of vent tube 112, float 166 is near the bottom of vent tube 112 allowing ball 164 at the upper end of spring 168 to drop below ball seat 162 thereby opening the air vent passage 114 to allow air flow into and out of reservoir 100. When the water level 120 rises, float 166 rises in vent tube 112 to push ball 164 upwardly toward and then against valve seat 162 to close air vent passage 114 and prevent air flow out of reservoir 100. This will cause the air pressure in the top of reservoir 100 to build up as water continues to flow into the reservoir and to stop flow of water into the reservoir as the air pressure in the reservoir equalizes with the atmospheric pressure acting on the bag and water in the bag.

Figure 8D:
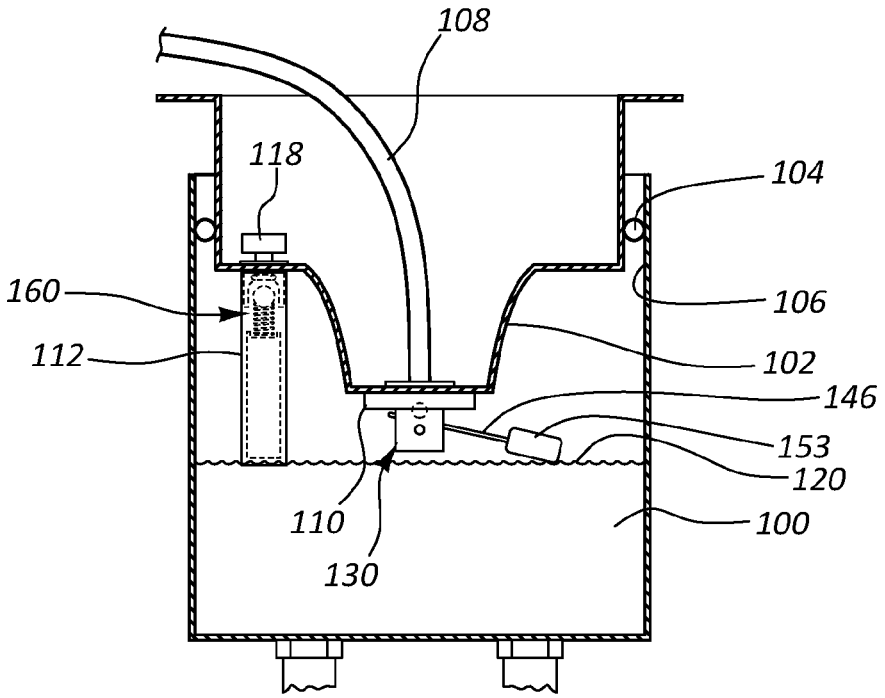
FIG. 8D is a simplified schematic vertical section similar to that of FIG. 8A showing a combination of the special float valve shown in FIG. 8B for controlling water flow from the water supply line and the float valve of FIG. 8C controlling the venting of the reservoir.

FIG. 8D shows the float valve 130 as previously described as the control for water flow into the reservoir and for the water level control, and shows the air vent float valve 160 as previously described as a backup safety feature if water control float valve 130 should malfunction.

Figure 8E:
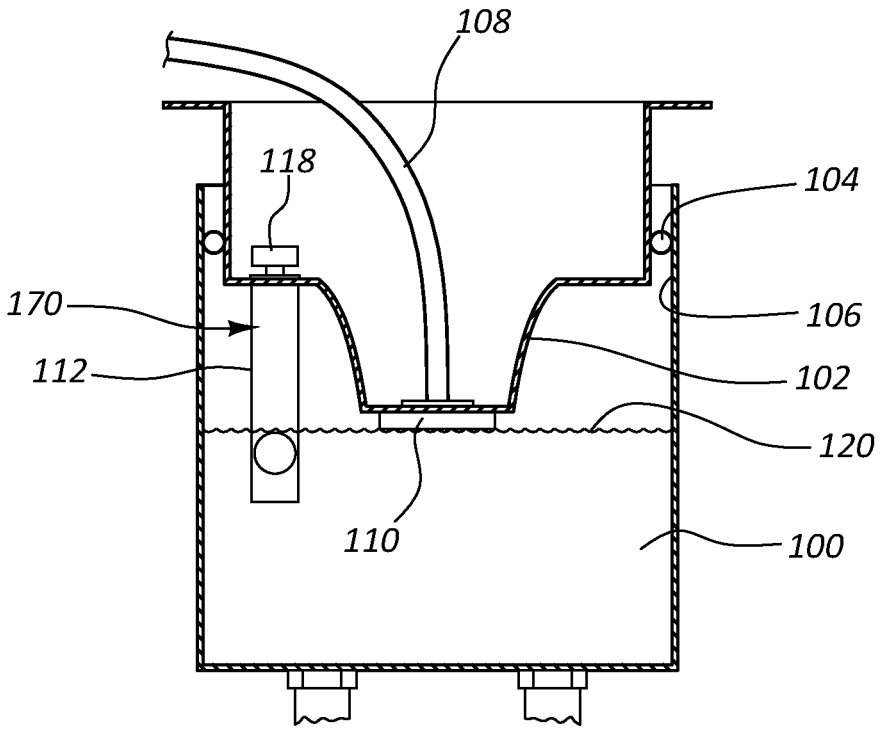
FIG. 8E is a simplified schematic vertical section similar to that of FIG. 8A showing a second embodiment of float valve for controlling the venting of the reservoir.
Figure 10A:
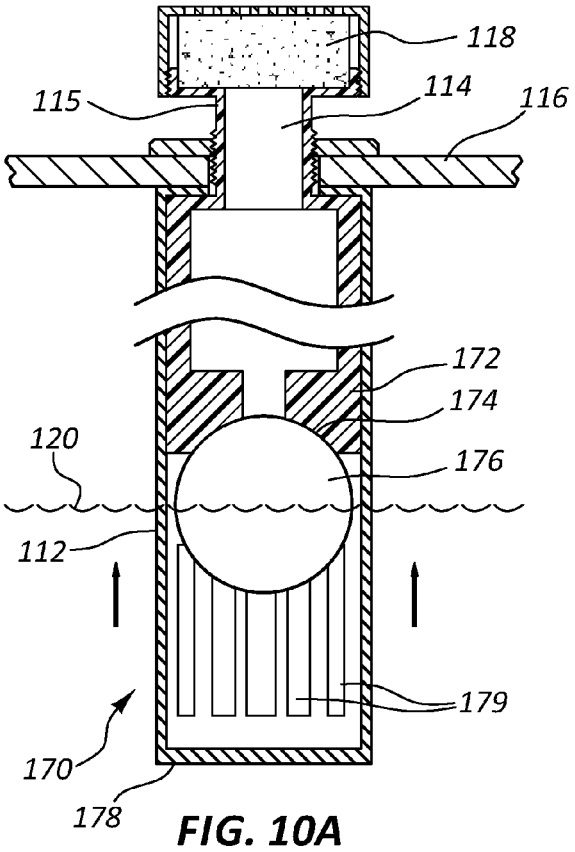
FIG. 10A is a vertical section showing details of the second embodiment of float valve for controlling the venting of the reservoir as shown in FIG. 8E with the water at a level in the reservoir to close the valve.
Figure 10B:
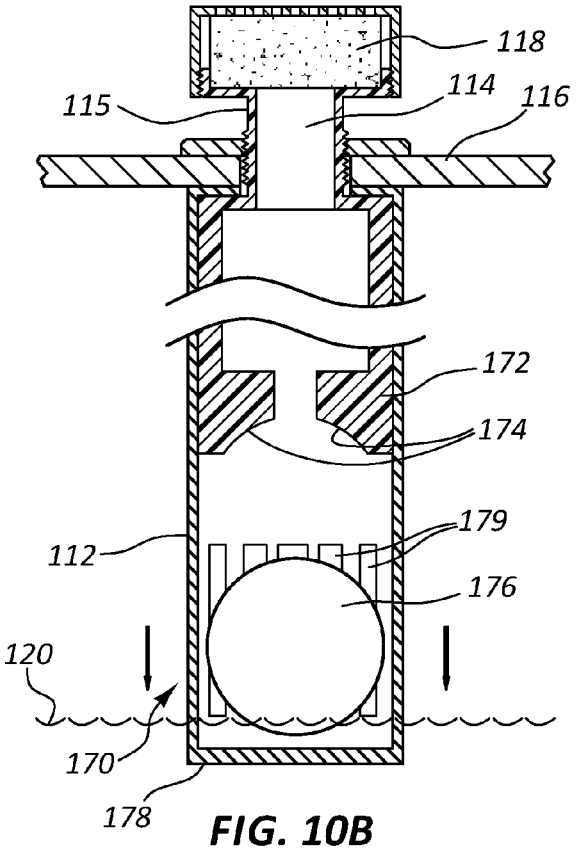
FIG. 10B is a vertical section showing details of the second embodiment of float valve for controlling the venting of the reservoir as shown in FIG. 8E with the water at a level in the reservoir to open the valve.

FIG. 8E shows the water outlet through bottom fitting 110 discharging directly into water reservoir 100 as shown for FIG. 8A. The flow of water into reservoir 100 and the level 120 of water in reservoir 100 is controlled by a second embodiment of float valve 170 in vent tube 112 which opens and closes the air vent into the reservoir. In the illustrated embodiment of this control, shown in more detail in FIGS. 10A and 10B, air vent tubing includes an insert 172 in its upper end which forms a ball seat 174 for a float ball 176. As shown in FIG. 10B, when water level 120 is low, ball 176 falls below ball seat 174 to open air vent tube 112 and allow air to flow into and out of reservoir 100. In this embodiment, air vent tube 112 includes a bottom 178 to prevent float ball 176 from falling out of the air vent tune 112 when the water level in reservoir drops well below the bottom of air vent tube 112 as can happen when all of the water in the bag-in-box container is used and the emptied bag-in-box container needs to be replaced with a new full bag-in-box container. Here openings 179 in the lower walls of air vent tube 112 allow air and water to flow into and out of the lower portion of air vent tube 112. When the water level 120 rises in the reservoir, it pushes floating ball 176 upwardly toward and the against ball seat 174 to close air vent tube 112 and prevent air flow out of the reservoir 100. FIG. 10A show the water level 120 pressing float ball 176 against ball seat 174 to close to close air vent tube 112.

While specific air vent controls and a specific water flow control have been shown and described, various other air vent controls and water flow controls can be used either alone or in combination to control the water flow into the reservoir and/or the air flow into and out of the reservoir.

While the description describes the bag-in-box container as containing water and is directed to the use of water and water dispensers, any liquid to be dispensed, where appropriate, can be used in place of water.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. An adapter for allowing a bag-in-box liquid container to be used with a conventional water cooler designed to use substantially rigid water bottles and having a reservoir for receiving water from the substantially rigid water bottle by gravity when inverted and positioned over the water reservoir, comprising:

a tray for receiving and holding a bag-in-box liquid container over the reservoir, said bag-in-box container including an inner container having a liquid therein;

a supply line connectable to the inner container when the bag-in-box container is positioned on the tray and through which liquid from the inner container can flow by gravity;

a cover adapted to be positioned over the reservoir for sealing the reservoir and for receiving a discharge end of the supply line and directing liquid from the discharge end of the supply line into the reservoir; and means for controlling flow of liquid from the supply line into the reservoir to control the level of water in the reservoir.

2. An adapter for allowing a bag-in-box water container to be used with a conventional water cooler according to claim 1, wherein the tray for receiving and holding a bag-in-box liquid container over the reservoir is supported by the cover.

3. An adapter for allowing a bag-in-box water container to be used with a conventional water cooler according to claim 2, wherein the cover includes a cone shaped entrance extending downwardly into the cover, wherein the discharge end of the supply line is received through the downwardly extending cone shaped entrance, and wherein the tray is supported by the cover spaced above the downwardly extending cone shaped entrance to allow the supply line to enter the downwardly extending cone shaped entrance beneath the tray.

4. An adapter for allowing a bag-in-box water container to be used with a conventional water cooler according to claim 1, wherein the inner container includes a connecting spout, wherein the supply line includes a connector adapted to connect to the connecting spout, and wherein the tray includes a front flange having a slot therein adapted to receive and hold the supply line connector.

5. An adapter for allowing a bag-in-box water container to be used with a conventional water cooler according to claim 1, wherein the tray includes side and back flanges for holding the bag-in-box container on the tray.

6. An adapter for allowing a bag-in-box water container to be used with a conventional water cooler according to claim 1, wherein the cover includes a vent from the reservoir to the atmosphere, wherein the means for controlling flow of liquid from the supply line into the reservoir to control the level of water in the reservoir includes a flow valve at the outlet end of the supply line responsive to the level of the liquid in the reservoir to allow flow of liquid from the supply line into the reservoir when the level of the liquid in the reservoir is below a desired level and to stop flow of liquid from the supply line into the reservoir when the level of liquid in the reservoir is at the desired level.

7. An adapter for allowing a bag-in-box water container to be used with a conventional water cooler according to claim 6, wherein the flow valve at the outlet end of the supply line is a float valve.

8. An adapter for allowing a bag-in-box water container to be used with a conventional water cooler according to claim 1, wherein the cover includes a vent from the reservoir to the atmosphere, wherein the means for controlling flow of liquid from the supply line into the reservoir to control the level of water in the reservoir includes a vent valve in the vent from the reservoir to the atmosphere responsive to the level of the liquid in the reservoir to allow flow of air through the vent into the reservoir when the level of the liquid in the reservoir is below a desired level and to stop flow of air from the reservoir when the level of liquid in the reservoir is at the desired level.

9. An adapter for allowing a bag-in-box water container to be used with a conventional water cooler according to claim 8, wherein the vent has an entrance in the reservoir, wherein the entrance is positioned in the reservoir at the desired level of liquid in the reservoir, and wherein the vent valve is a hydrophobic membrane that allows air to pass therethrough and does not allow liquid to pass therethrough whereby when the liquid is below the entrance, air can flow through the membrane and vent and when the liquid is in contact with the membrane, air cannot flow through the membrane and vent.

10. An adapter for allowing a bag-in-box water container to be used with a conventional water cooler according to claim 8, wherein the vent valve is a float valve in the vent responsive to the level of liquid in the reservoir whereby when the liquid in the reservoir is below the desired level, the float is below a float seat to allow flow of air through the vent and when the level of the liquid is at the desired level, the float is against the float seat to prevent flow of air through the vent.

* * * * *